US009534522B2

(12) United States Patent
Gommans

(10) Patent No.: US 9,534,522 B2
(45) Date of Patent: Jan. 3, 2017

(54) MUFFLER FOR AN EXHAUST SYSTEM OF AN INTERNAL COMBUSTION ENGINE

(71) Applicant: Bosal Emission Control Systems NV, Lummen (BE)

(72) Inventor: Leo Gommans, Lanaken (BE)

(73) Assignee: Bosal Emission Control Systems NV, Lummen (BE)

( * ) Notice: Subject to any disclaimer, the term of this patent is extended or adjusted under 35 U.S.C. 154(b) by 0 days.

(21) Appl. No.: 15/076,190

(22) Filed: Mar. 21, 2016

(65) Prior Publication Data

US 2016/0281559 A1 Sep. 29, 2016

(30) Foreign Application Priority Data

Mar. 23, 2015 (EP) ..... 15160260

(51) Int. Cl.
*F01N 1/08* (2006.01)

(52) U.S. Cl.
CPC ..... *F01N 1/083* (2013.01)

(58) Field of Classification Search
CPC ..... F01N 1/083
USPC ..... 181/268, 212
See application file for complete search history.

(56) References Cited

U.S. PATENT DOCUMENTS 2,019,746 A * 11/1935 Tatter ..... F01N 1/083 181/281
2,761,525 A 9/1956 Moss
3,515,242 A * 6/1970 Lyttle ..... F01N 1/02 181/268
4,192,403 A * 3/1980 Nakagawa ..... F01N 1/089 181/268
4,501,341 A * 2/1985 Jones ..... F01N 1/006 181/250
4,858,722 A 8/1989 Abbe et al.
5,949,035 A * 9/1999 Herold ..... F01N 1/08 181/282
7,219,764 B1 * 5/2007 Forbes ..... F01N 1/02 181/270
7,243,757 B2 * 7/2007 Stuber ..... F01N 1/02 181/249
7,287,622 B2 * 10/2007 Rauch ..... F01N 1/02 181/231

(Continued)

FOREIGN PATENT DOCUMENTS

DE 1299648 B 7/1969

OTHER PUBLICATIONS

Extended European Search Report for EP Application No. 15160260.4 mailed Sep. 16, 2015 (7 pages).

*Primary Examiner* — Forrest M Phillips
(74) *Attorney, Agent, or Firm* — Merchant & Gould P.C.

(57) ABSTRACT

A muffler for an exhaust system of an internal combustion engine, comprises a housing comprising a shell having an inner wall, an inlet pipe and an outlet pipe, the inlet pipe and the outlet pipe extending into an inner space of the housing, for conveying an exhaust gas stream into and out of the inner space of the housing, at least one baffle arranged in the inner space of the housing, the baffle comprising a baffle plate, the baffle plate having a circumference, and a baffle lip arranged at the circumference of the baffle plate, the baffle lip engaging the inner wall of the shell and having an end portion, wherein the end portion of the baffle lip is curved inwardly away from the inner wall of the shell.

14 Claims, 8 Drawing Sheets

(56) References Cited

U.S. PATENT DOCUMENTS

| | | | | |
|---|---|---|---|---|
| 8,770,342 | B2 * | 7/2014 | Wirth | F01N 1/026<br>181/268 |
| 2006/0096805 | A1 * | 5/2006 | Staut | F01N 1/083<br>181/271 |
| 2010/0006370 | A1 * | 1/2010 | Shaya | F01N 1/083<br>181/268 |

* cited by examiner

MUFFLER FOR AN EXHAUST SYSTEM OF AN INTERNAL COMBUSTION ENGINE

This application claims benefit of Serial No. 15160260.4, filed on 23 Mar. 2015 in the European Patent Office and which application is incorporated herein by reference. To the extent appropriate, a claim of priority is made to the above disclosed application.

FIELD OF THE INVENTION

The invention relates to a muffler for an exhaust system of an internal combustion engine.

BACKGROUND

Mufflers are used, for example, as components of exhaust systems of motor vehicles in general, and in particular as components of exhausts systems of cars. The muffler is designed to reduce the noise levels generated by the internal combustion engine. To this end, the acoustical waves propagate through a series of resonating chambers tuned to attenuate the noise. Alternatively or in addition, fibrous material may be arranged in one or more chambers of the muffler to attenuate the loudness of the sound pressure. The chambers within the muffler are formed by sectional plates called baffles which are inserted into a shell during assembly of the muffler. The baffles additionally may support various pipes within the muffler, for example the inlet pipe and the outlet pipe of the muffler.

Generally, a chamber of the muffler is bounded by a pair of baffles or between baffle and endcap and the shell. A first pipe may be arranged to extend through the baffle plate of one baffle of the pair and may have a discharge end opening out into the chamber. A second pipe may extend through the baffle plate of the other baffle of the pair into the chamber and may have an inlet end also opening out into the chamber for allowing exhaust gas and acoustic waves to exit from the chamber. In some embodiments of mufflers, a perforated flow pipe may extend completely through the chamber bounded by the two baffles and the shell, allowing exhaust gas and acoustic waves to enter and exit the chamber through these perforations. In still further embodiments of mufflers, the flow pipe is not perforated and constitutes a bypass of the chamber, so that exhaust gas and acoustic waves may enter and exit the bypassed chamber either through discharge and inlet ends of other pipes opening out into this chamber, or through perforations provided in the baffle plates bounding this chamber.

During assembly of the muffler, the baffles are inserted into the shell by a process called "stuffing". The baffles not only comprise the baffle plate but in addition comprise a bent edge called "baffle lip" which upon being stuffed into the shell is in a frictional sliding contact with the shell.

As is evident, the baffles have different functions. First, the baffles divide the muffler into acoustical compartments. The baffles may additionally contain holes which create an acoustical connection between the acoustical compartments. Second, the baffles support the pipes. Third, the baffles to some extent decouple the elements arranged in the interior of the muffler and the shell with respect to thermal expansion by providing a sliding contact between the interior elements of the muffler and its housing.

During stuffing in the assembly of the muffler as well as upon thermal expansion or contraction in operation, frictional forces are exerted on the baffle lip. These frictional forces may increase due to "baffle edge gripping" (the edge of the baffle "grips" into the inner wall of the shell). Baffle edge gripping may lead to different sliding properties of the baffle edge in the two opposite directions along the inner wall of the shell and is a consequence of the process of manufacturing the baffles (including stamping and cutting of metal sheets which results in spring-back of the tips of the baffle lip). This process of manufacturing the baffles lead to baffle lip tips which are bent outwardly towards the inner wall of the muffler shell.

The afore-described outwardly bent baffle lip tips also have a negative impact on the "stick and slip" movement of the baffle. The stick and slip movement of the baffle typically occurs during the heat-up of the muffler during operation, or the cooling down of the muffler after operation and generates the well-known "tick and ping" noise.

The frictional forces may result in bending of the baffle plate. Accordingly, reduction of the wall thickness of the baffle (and an associated saving of weight) is very limited only, since a further reduction of the wall thickness of the baffle would increase the tendency of the baffle plate to bend due to reduced stiffness of the baffle plate which may create problems regarding the stuffing of the baffle plate into the muffler shell during assembly of the muffler and which may also create loss of the function of the muffler due to thermal cycling.

SUMMARY OF THE INVENTION

It is therefore an object of the present invention to provide a new muffler for an exhaust system of an internal combustion engine solving the above described problems. The muffler according to the invention is particularly suitable as automotive muffler or as truck muffler.

In order to overcome these problems, the present invention suggests a device as it is specified by the features of the independent claim. Embodiments of the device according to the invention are the subject matter of the dependent claims.

The muffler for an exhaust system of an internal combustion engine according to the invention comprises a housing comprising a shell having an inner wall, an inlet pipe and an outlet pipe. The inlet pipe and the outlet pipe extend into an inner space of the housing, for conveying an exhaust gas stream into and out of the inner space of the housing. At least one baffle is arranged in the inner space of the housing and is made of at least one metal sheet. The baffle comprises a baffle plate having a circumference, a curved connection portion and a baffle lip arranged at the circumference of the baffle plate. The baffle lip is connected to the baffle plate through a curved connection portion and the baffle lip engages the inner wall of the shell and has an end portion. The end portion of the baffle lip is curved inwardly away from the inner wall of the shell and the inwardly curved end portion of the baffle lip has a tip. The baffle lip has a contact portion which is in contact with the inner wall of the shell, the contact portion being arranged between the curved connection portion and the inwardly curved end portion of the baffle lip. The inwardly curved end portion has a curvature angle varying along the circumference of the baffle plate. The curvature angle is formed between a tangent to a metal sheet face of the contact portion engaging the inner wall of the shell and a tangent to the inwardly curved end portion of the baffle lip at the tip of the inwardly curved end portion on the same metal sheet face being in contact with the inner wall of the shell at the contact portion.

The tip of the baffle lip is the extreme distal end of the baffle lip.

According to one aspect of the invention of the muffler, the contact portion has a contact portion length, wherein the contact portion length varies along the circumference of the baffle plate.

The contact portion length is the length between the curved connection portion and the inwardly curved end portion of the baffle lip.

In a further aspect of the invention, the baffle lip has a developed length ranging from the curved connection portion to the tip of the inwardly curved end portion of the baffle lip and the variation of the developed length is less than 10 mm, particularly less than 5 mm, very particularly 2 mm, around the circumference of the baffle plate.

The developed length of the baffle lip is the total length of the baffle lip from the baffle plate to the tip of the baffle lip along the metal sheet, which is the length of a corresponding flat, straight material for forming the baffle lip. Hence, the developed length has at least one minimum and at least one maximum and the variation between the minimum and the maximum of the developed length is less than 10 mm, particularly less than 5 mm, very particularly 2 mm, According to another aspect of the invention, the developed length of the baffle lip is constant around the circumference of the baffle plate. Accordingly, the developed length of the baffle lip is identical at each location around the circumference of the baffle plate and does not vary.

According to yet a further aspect of the invention, the curvature angle of the inwardly curved end portion is reduced with decreasing contact portion bending radius along the circumference of the baffle plate.

Still in accordance with a further aspect of the invention, the length of the contact portion of the baffle lip is reduced with increasing curvature angle of the inwardly curved end portion.

In accordance with another aspect of the invention, the inwardly curved end portion of the baffle lip can be described by at least one osculating circle having a radius of curvature corresponding to the curvature of the inwardly curved end portion at a location on the inwardly curved end portion and wherein the radius of curvature of the at least one osculating circle varies along the circumference of the baffle plate. In particular, the inwardly curved end portion may describe an arc of a circle. Alternatively, the radius of curvature of the at least one osculating circle corresponding to the curvature of the inwardly curved end portion varies along the circumference of the baffle plate along at least one plane parallel to the baffle plate.

Yet in accordance with another aspect of the invention, the curved connection portion can be described by at least one osculating circle having a radius of curvature corresponding to the curvature of the curved connection portion at a location on the curved connection portion wherein the radius of curvature of the at least one osculating circle varies along the circumference of the baffle plate. In particular, the curved connection portion may describe an arc of a circle. Alternatively, the radius of curvature of the at least one osculating circle corresponding to the curved connection portion varies along the circumference of the baffle plate along at least one plane parallel to the baffle plate.

In a further aspect of the invention, the contact portion of the baffle lip has a length of up to 10 mm, preferably in the range of 5 mm to 10 mm.

In another aspect of the present invention, the baffle plate further comprises stiffening sections such as a bead, an indentation or a rib. The stiffening section may be in shape of a bead protruding in the same direction as the baffle lip. The bead may alternatively also protrude in the opposite direction of the baffle lip. The stiffening sections may have a linear shape or a cross shape in form of a rib or may be irregularly shaped indentations or dents.

According to another aspect of the invention, at least one baffle plate has perforations.

In accordance with a further aspect of the invention, the at least one baffle plate has at least one orifice, the at least one orifice receiving the inlet pipe or the outlet pipe.

According to a further aspect, the baffle comprises a first and a second baffle element, each of the first and second baffle elements comprising a baffle plate element having a respective circumference and the baffle plate element of the first baffle element abutting the baffle plate element of the second baffle element, and each baffle plate element having a baffle lip element arranged at the circumference of each respective baffle plate element. Each of the baffle lip element engages the inner wall of the shell and has an end portion element, wherein the end portion element of each baffle lip element is curved inwardly away from the inner wall of the shell. The baffle lip element of the baffle plate element of the first baffle element is furthermore arranged in opposite direction to the second baffle lip element the baffle plate element of the second baffle element with respect to the plane formed by the baffle plate elements.

Particularly, the inwardly curved end portion of the baffle lip at each curved point may be described by an osculating circle, whose radius of curvature varies along the inwardly curved end portion. In case the radius of curvature does not vary along the inwardly curved end portion, the inwardly curved end portion describes an arc of a circle. In case the inwardly curved end portion describes an ellipse, for example, or any other shape deviating from an arc of a circle, the radius of curvature does vary along the inwardly curved end portion of the baffle lip.

The osculating circle at a given point on the inwardly curved end portion of the baffle lip may be defined as the circle passing through this point and a pair of additional points on the inwardly curved end portion infinitesimally close to the first point. The center of the osculating circle lies on the inner normal line, and its curvature is the same as that of the given inwardly curved end portion at that point.

In particular, the at least one baffle is made of at least one metal sheet, particularly the baffle is made of two or more metal sheets, and the baffle has a total thickness t of up to 2 mm, in particular a total thickness of up to 1.5 mm, more particular a total thickness of up to 1.2 mm, and very particularly a total thickness of up to 0.8 mm. The baffle may particularly have a total thickness of at least 0.1 mm, particularly a total thickness of at least 0.2 mm, and very particularly a total thickness of at least 0.4 mm. The total thickness t of the baffle is defined in the present application as being the sum of the thicknesses of the at least one metal sheet the baffle is made of, particularly the sum of the thicknesses of the two or more metal sheets the baffle is made of. If only one metal sheet is used, the total thickness t of the baffle is the thickness of the metal sheet The tip of the inwardly curved end portion of the baffle lip is particularly arranged at a distance d from the inner wall of the shell, the distance d being at least 0.5 times the total thickness t of the baffle. The distance d may be constant or may vary along the circumference of the baffle.

The end portion of the baffle lip may be curved to have the shape of an arc of a circle having a radius R in the range of 1 times the total thickness t to 10 times the total thickness t of the baffle, preferably 2 times the total thickness t to 5 times the total thickness t of the baffle.

Particularly, the curved end portion of the baffle lip which has the shape of an arc of a circle may subtend an angle θ of up to 322° with the center of the arc of the circle. The angle $\theta_{max}$ is the maximum angle of the curvature of the baffle lip obtained when the tip of the curved end portion of the baffle lip contacts the baffle lip.

The curved connection portion through which the baffle lip is connected to the baffle plate may have the shape of an arc of a circle having a radius R' in the range of 1 times the total thickness t to 10 times the total thickness t of the baffle, preferably 2 times the total thickness t to 5 times the total thickness t of the baffle. Particularly, the curved connection portion has the shape of an arc of a circle subtending an angle θ' of 90° with the center of the arc of the circle.

Any previous aspect may also equally apply to this additional baffle without specifically reciting all aspects again.

The geometry of the end of the baffle lip according to the present invention avoids gripping of the baffle into the inner wall of the housing of the muffler and improves the sliding contact between the baffles and the shell of the muffler housing. The static friction force is reduced, thereby reducing the stick-slip phenomenon when the baffle is brought under tension to eventually start sliding during the stuffing process or during heating up and cooling down of the muffler at lower forces applied on the baffle. The reduced tension reduces the forces applied to the baffle and therefore reduces the risk of bending the baffle. Additionally, the geometry of the baffle lip according to the present invention allows the introduction of the baffle into the housing of the muffler in either direction during stuffing process. Furthermore, the curved end portion of the baffle lip increases the stiffness of the baffle.

The varying geometries of the baffle lip allows for fine-tuning of the properties of the baffle, for example regarding the stiffness of the baffle plate, and at the same time reducing the amount of material needed (metal sheet) for forming such optimized baffle. This optimization additionally has a beneficial impact on the weight of the muffler, in which these baffles are arranged, further contributing to the manufacture of light weight mufflers.

The curvature angle of the inwardly curved end portion along the circumference of the baffle plate may be varied where necessary for optimal stiffness and reduced weight of the baffle.

The curvature angle of the inwardly curved end portion along the circumference of the baffle plate may be varied while reducing or increasing the length of the contact portion depending on the contact pressure of the muffler shell on the baffle leading to the necessity of a certain length of the contact portion for compensation of the applied contact pressure. For example, the contact pressure of the muffler shell on the baffle generally is higher at the corners of the muffler, where the muffler shell has a smaller contact portion bending radius, than at the flat intermediate portions between the corners of the muffler, where the muffler shell has a larger contact portion bending radius than at the corners. Therefore, the optimization of the length of the contact portion simultaneously with the curvature angle of the inwardly curved end portion of the baffle lip allows for compensating the contact pressure (bending stress) around the circumference of the baffle plate while enhancing the stiffness of the baffle with reduced weight.

In particular, when the developed length of the baffle lip is kept constant or at least substantially constant around the circumference of the baffle plate despite the geometry variations, the stiffness of the baffle may be fine-tuned while keeping the weight of the baffle constant or substantially constant.

By the use of several metal sheets for the baffle, the friction between the metal sheets additionally increases the damping of vibrations in the muffler. The present invention also allows the use of baffles whose baffle lip has no contact portion with the inner wall of the shell. In general, the present invention presents the advantage of maintaining good contact between baffle and housing, reducing noise due to sliding and enhances mechanical durability of the muffler, allowing the usage of thinner thicknesses t of the baffles.

DETAILED DESCRIPTION OF EMBODIMENTS

Figure 1:
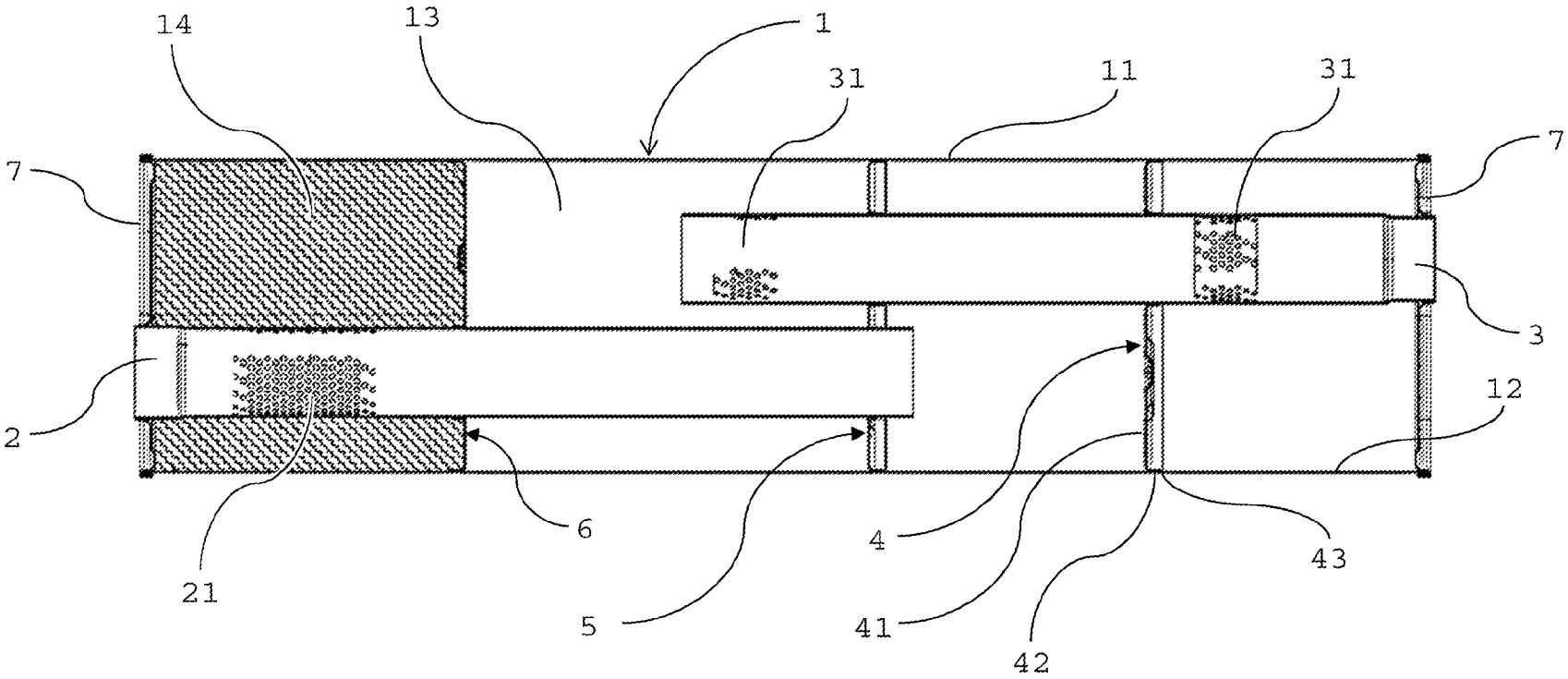
FIG. 1 is a vertical sectional view of one embodiment of a muffler according to the present invention.

As shown in FIG. 1, a muffler includes a housing 1 comprising a shell 11 having an inner wall 12 and receiving an inlet pipe 2 and an outlet pipe 3 both extending into an inner space formed by the housing 1. An inner space 13 is delimited by the shell 11 and by end-caps 7 of the housing. The end-caps 7 seal the housing 1 and generally comprise an orifice for receiving the inlet pipe 2 and/or the outlet pipe 3.

The inlet pipe 2 conveys exhaust gas stream from an exhaust of an internal combustion engine into the inner space 13 of the housing 1 and the outlet pipe 3 conveys the exhaust gas stream out of the inner space 13 of the housing 1.

As shown in FIG. 1, the muffler has three baffles 4, 5, 6 arranged at a defined distance from each other inside the housing 1 in the inner space 13 of the muffler. The baffle plates 4, 5, 6 each comprise a baffle plate and a baffle lip arranged at the circumference of the respective baffle plate, which will be explained in the following for baffle 4 comprising baffle plate 41 and baffle lip 42. The baffle lip 42 has an end portion 43 which is curved inwardly away from the inner wall 12 of the shell 11. Due to the scale of FIG. 1, the inwardly curved end portion 43 according to the present invention is not visible on the figure.

Each of the baffle 4, 5 receives the inlet pipe 2 as well as the outlet pipe 3 extending through the respective baffles 4, 5 while baffle 6 only receives the inlet pipe 2. In another embodiment, the inlet and outlet pipes may not extend between the baffle plates 4 and 5, or 5 and 6, respectively.

In the particular embodiment, wherein the pipe 3 extends through two baffles 4 and 5, baffle 4 has one orifice for receiving the outlet pipe 3 and baffle 5 has two orifices for receiving both the inlet pipe 2 and the outlet pipe 3.

As can be seen in FIG. 1, the inlet pipe 2 and outlet pipe 3 may be perforated over defined sections 21 and 31 for specific tuning of the sound attenuation effect of the muffler.

Particularly, the perforated section 21 in the inlet pipe 2 opens into a chamber formed by one end-cap 7 receiving the inlet pipe 2 and one baffle 6 also receiving the inlet pipe 2. The chamber 14 is filled with glass wool fibers.

The baffles 4, 5 and 6 may be made of at least one metal sheet, in particular of steel, particularly of stainless steel. The baffles 4, 5, 6 may also be obtained by using two or more metal sheets, for example by superposing two or more metal sheets and stamping the superposed metal sheets to form the desired baffle 4, 5, 6. The friction between several metal sheets additionally increase the damping of vibrations in the muffler.

In preferred embodiments, the inlet and outlet tubes 2 and 3 may have a diameter of from 30 mm to 130 mm and may be made of steel, particularly stainless steel.

Figure 2:
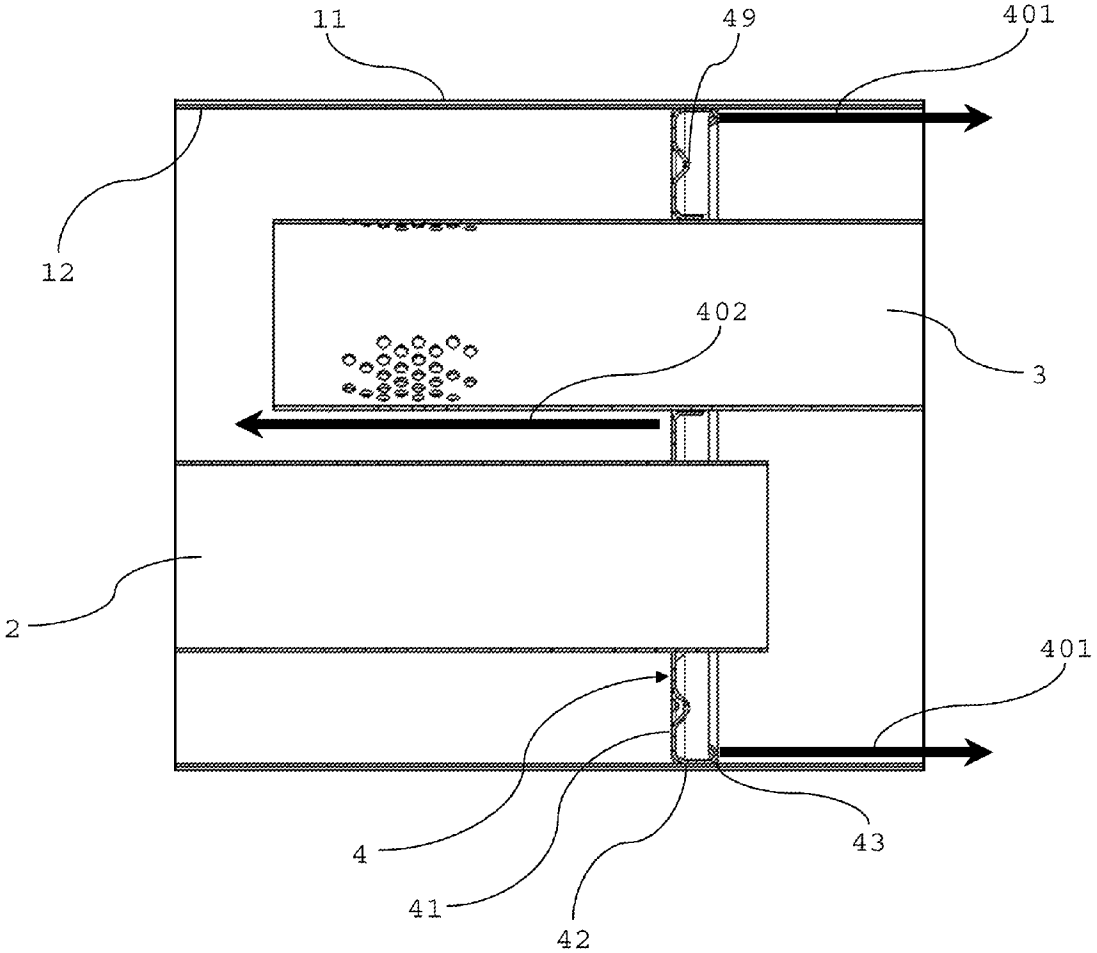
FIG. 2 is a vertical sectional view of a muffler showing pushing/pulling and friction forces.

FIG. 2 depicts a schematic representation of the forces exerted on the baffle 4 caused by thermal expansion during heat-up of the muffler. The friction force 401 at the circumference of the baffle plate 41 results from the sliding contact of the baffle 4 and the housing 11 and plays a role in the deformation of the baffle 4 and/or in a possible damage to the baffle 4 and/or the muffler housing 11. The deformation of the baffle 4 is caused by the force pair 401 and 402 occurring during thermal expansion or thermal contraction during or after operation. In FIG. 2, the baffle 4 further has indentations 49 stiffening the baffle for further enhancement of the stiffness of the baffle 4.

Figure 3:
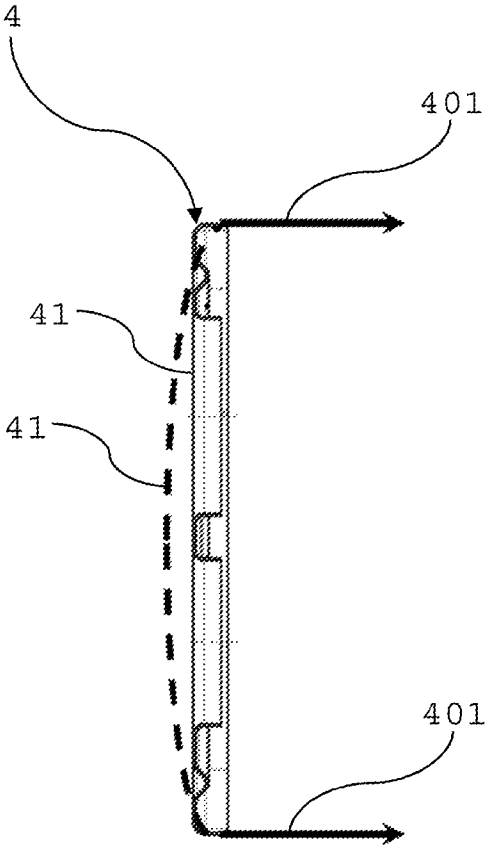
FIG. 3 is a vertical sectional view of a standard baffle illustrating the baffle deformation due to the friction forces.

FIG. 3 illustrates the direct impact of the force pair 401 and 402 onto the deformation of a baffle according to the prior art. As the forces 401 and 402 increase due to various phenomena occurring, the baffle plate tends to bend (deform) under the influence of the force pair 401 and 402. One way to reduce deformation of the baffle and ultimately to avoid irreversible damage to the baffle and to the muffler is to increase the stiffness of the baffle by using a metal sheet having an increased thickness t and hence resulting in higher total weight of the muffler. Another way to reduce deformation of the baffle and irreversible damage to the baffle is by diminishing the frictional force exerted on the baffle by increasing the circumference of the housing and thus the baffles are more loosely fitted in the housing. However this procedure does not guarantee the contact between the baffle and the housing at all times, increasing the risk of noise radiation by the housing, more particularly rattling noise and ultimately irreversible damage of the muffler.

On the contrary to the baffle according to the prior art, the baffle 4 according to the present invention reduces the forces exerted on the baffle 4. Ideally, the friction force 401 exerted on the baffle 4 is very low and the baffle plate 41 does not bend or deform even with a low total thickness t of the baffle 4.

The friction force 401 is strongly affected by the geometry of the baffle lip 42 and the potential gripping of the tip 44 of the baffle lip 42 into the inner wall 12 of the shell 11 of the muffler housing 1. The geometry of the end portion 43 of the baffle lip 42 which will be discussed drastically reduces the friction force 401 along the circumference of the baffle plate 41 and hence has a direct impact on reduction of the deformation of the baffle 4 and the damage to the baffle and/or to the muffler . Similarly, the pushing and pulling force 402 exerted by the inlet pipe 2 and/or of the outlet pipe 3 may additionally affect the deformation of the baffle 4 and may also be reduced accordingly by using similar geometries at the orifices of the baffles through which the inlet pipe and/or the outlet pipe extend. Further increasing the stiffness of the baffle additionally reduces the risk of deformation of the baffle and hence the risk of damaging the baffle or the muffler housing.

Figure 4:
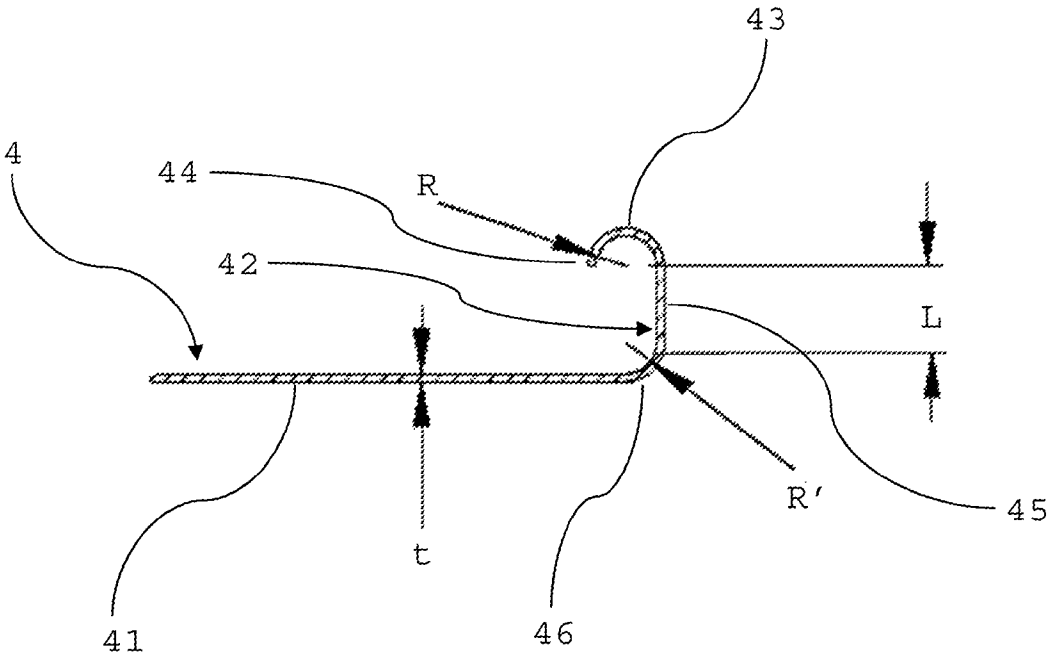
FIG. 4 is a sectional view of a part of a baffle of a muffler according to the present invention.

In FIG. 4, a schematic sectional view of a baffle 4 according to a particular embodiment of the invention is depicted. The baffle 4 has a baffle plate 41 and a baffle lip 42 comprising a contact portion 45 in contact with the inner wall 12 of the shell 11 of the housing when being arranged in the shell 11, an inwardly curved end portion 43 of the lip 42 as well as a tip 44 of the inwardly curved end portion. The contact portion has a contact portion length L which is the length between the curved connection portion 46 and the inwardly curved end portion 43 of the baffle lip 42.

The baffle as well as its portions are made of at least one metal sheet having a total thickness t. The baffle lip 42 is connected to the baffle plate 41 through a curved connection portion 46 which has the shape of an arc of a circle having a radius R', and preferably subtends an angle θ' of 90° with the center of the arc of the circle of the curved connection portion 46.

The end portion 43 of the baffle lip 42 is curved to have the shape of an arc of a circle having a radius R and subtending an angle $\theta_{max}$ of up to 322° with the center of the arc of the circle.

Figure 5:
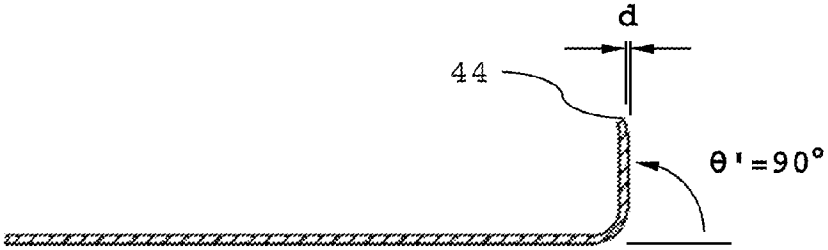
FIG. 5 is a sectional view of a part of a baffle of a muffler according to the present invention showing a baffle lip end with a minimal curvature.

FIGS. 5 to 8 show several particular embodiments according to the present invention in which the end portion 43 of the baffle lip 42 which is curved inwardly away from the inner wall 12 of the shell 11 when being arranged in the shell 11 has different geometries. In FIG. 5, the tip 44 of the inwardly curved end portion 43 of the baffle lip 42 has a minimal curvature only so as not to contact the inner wall 12 of the shell.

Figure 6:
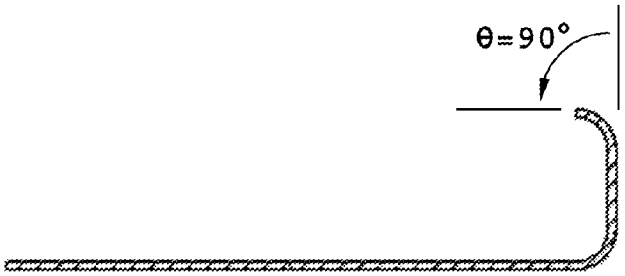
FIG. 6 is a sectional view of a part of a baffle of a muffler according to the present invention showing a baffle lip end with a curvature angle θ of 90°.
Figure 8:
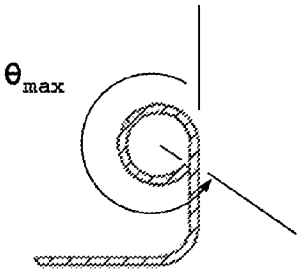
FIG. 8 is a sectional view of a part of a baffle of a muffler according to the present invention showing a baffle lip end with a maximal curvature.
Figure 7:
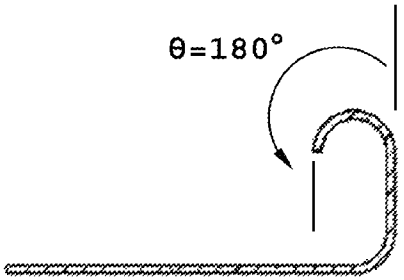
FIG. 7 is a sectional view of a part of a baffle of a muffler according to the present invention showing a baffle lip end with a curvature angle θ of 180°.

The curvature results in that the tip 44 of the baffle lip is arranged a distance d away from the inner wall 12 of the shell 11 in the muffler and hence avoids gripping of the tip 44 of the baffle lip 42 into the inner wall 12 of the shell 11. FIGS. 6 and 7 depict specific curvatures of the end portion 43 of the baffle lip 42 describing an arc of a circle subtending an angle θ of 90° and 180° with the center of the arc of the circle. FIG. 8 shows a specific embodiment, wherein the end portion 43 of the lip 42 describes an arc of the circle wherein the subtended angle is such that the tip 44 of the end portion 43 of the baffle lip 42 contacts the baffle lip 42. This angle $\theta_{max}$ is the maximum subtended angle wherein the tip 44 of the curved end portion 43 of the baffle lip 42 contacts the baffle lip 42.

Figure 10:
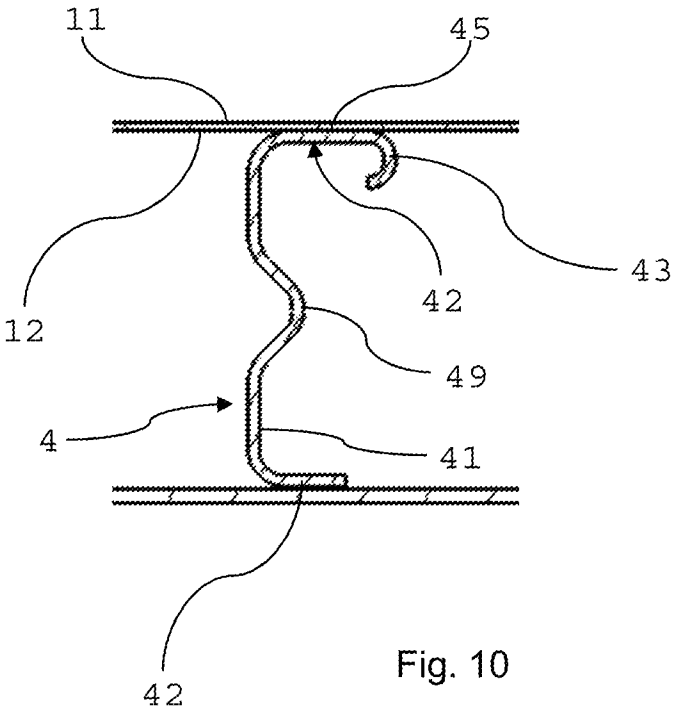
FIG. 10 is a vertical sectional view of part of a baffle according to another embodiment of the present invention with a stiffening bead.
Figure 9:
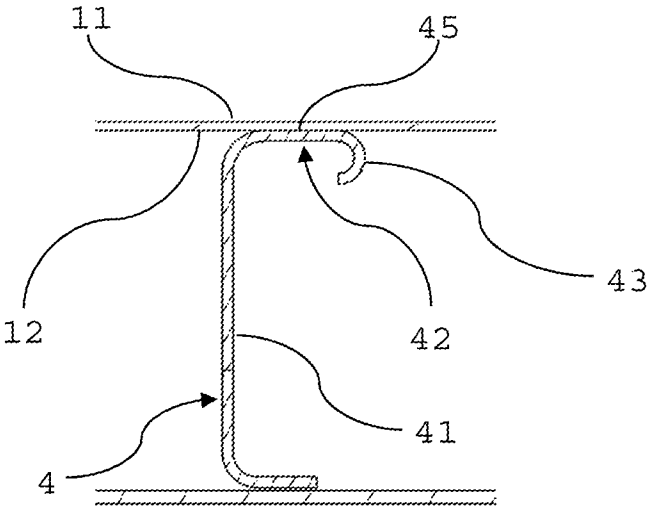
FIG. 9 is a vertical sectional view of part of a baffle according to one embodiment of the present invention without stiffening bead.

FIG. 9 and FIG. 10 depict sectional view of a baffle 4 according to a particular embodiment of the invention. In FIG. 9 and FIG. 10, the baffle 4 has a baffle plate 41 and a baffle lip 42 comprising a contact portion 45 in contact with the inner wall 12 of the shell 11 of the housing when being arranged in the shell 11, an inwardly curved end portion 43 of the lip 42. The baffle in FIG. 9 does not have stiffening sections such as a bead, an indentation or a rib, whereas the baffle in FIG. 10 has a stiffening section in shape of a bead 49 protruding in the same direction as the baffle lip 42. The bead 49 may alternatively also protrude in the opposite direction of the baffle lip 42. The geometry (shape and size) of the stiffening sections and their number and position may be designed such to improve the structural stiffness of the baffle. The stiffening sections 49 may have a linear shape or a cross shape in form of a rib or may be irregularly shaped indentations or dents.

Figure 11:
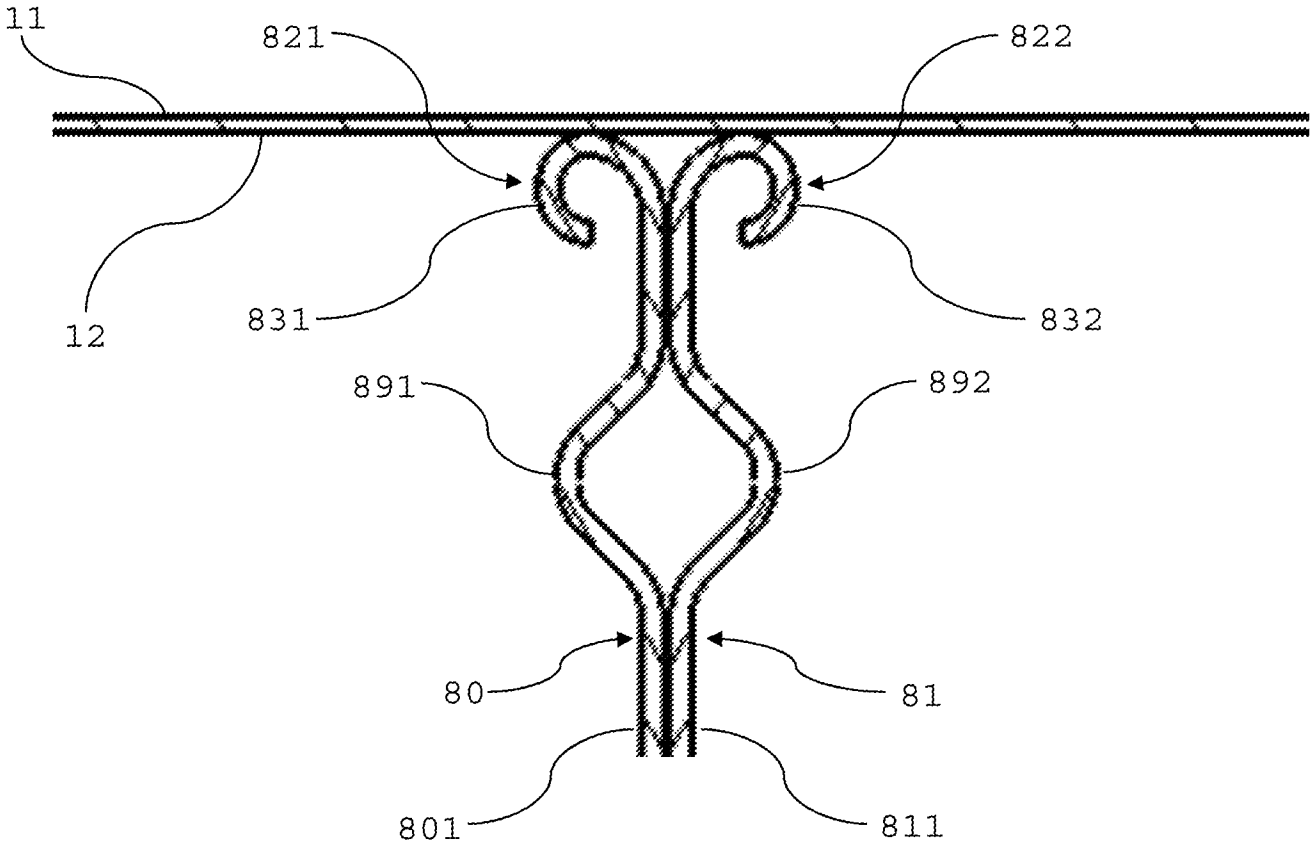
FIG. 11 is a vertical sectional view of part of two baffle elements forming a baffle according to a further embodiment of the present invention.

In FIG. 11 a further embodiment according to the invention is shown. In this embodiment two baffle elements 80 and 81 are abutting along their respective baffle plate elements 801 and 811. The baffle elements 80 and 81 together form the baffle 4. The baffle plate elements 801 and 811 contact each other over at least part of the surface of the baffle plate elements 801 and 811. Both baffles have a baffle lip element 821 and 822 arranged at the circumference of each respective baffle plate element 801 and 811. The baffle lip elements 821 and 822 both have inwardly curved end portions 831 and 832, respectively. The baffle elements 80 and 81 further comprise stiffening sections 891 and 892 in shape of a bead and protruding in the same direction as the baffle lip element 821 and 822 respectively. These stiffening sections 891 and 892 may have various geometries (shape and size) and positions, and may be formed as mirrored pairs wherein the stiffening sections 891 and 892 have same position and geometries on the baffle element pairs 80 and 81, respectively, the protruding parts being in opposite directions relative to the baffle plates 801 and 811. Alternatively, the stiffening sections 892 on the second baffle element 81 may have positions and geometries differing from the position and geometries of the stiffening sections 891 of the first baffle element 80. In the latter case, the geometry and position of the stiffening sections 891 and 892 may be designed such to improve the structural vibrations over a broad frequency range when the resonance frequencies of both baffles are non-identical. The friction between the two baffles 80 and 81 additionally increase the damping of vibrations in the muffler.

Figure 12:
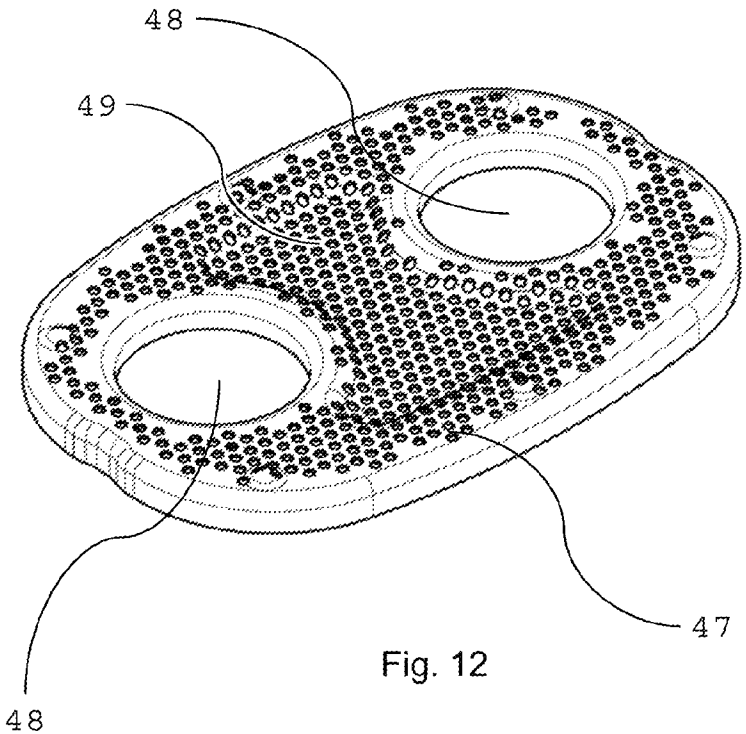
FIG. 12 is view of a perforated baffle of a muffler according to the present invention.

FIG. 12 shows a particular embodiment of the present invention. The baffle depicted is perforated and the perforations also allow for tuning of the acoustic attenuation of the muffler. To this end, the number of perforations 47 as well as their diameter may be varied to obtain a customized sound attenuation. The perforations may also be in the sub-millimeter range (micro-perforated baffle plate 41). The baffle shown in FIG. 12 also has two orifices 48 for receiving, for example, the inlet pipe 2 and the outlet pipe 3. In other embodiments, the baffle may be designed with more or less orifices. The orifices 48 are usually formed in the baffle plate by stamping and may also have lips with geometries similar to the geometry of the baffle lip 42.

Figure 13:
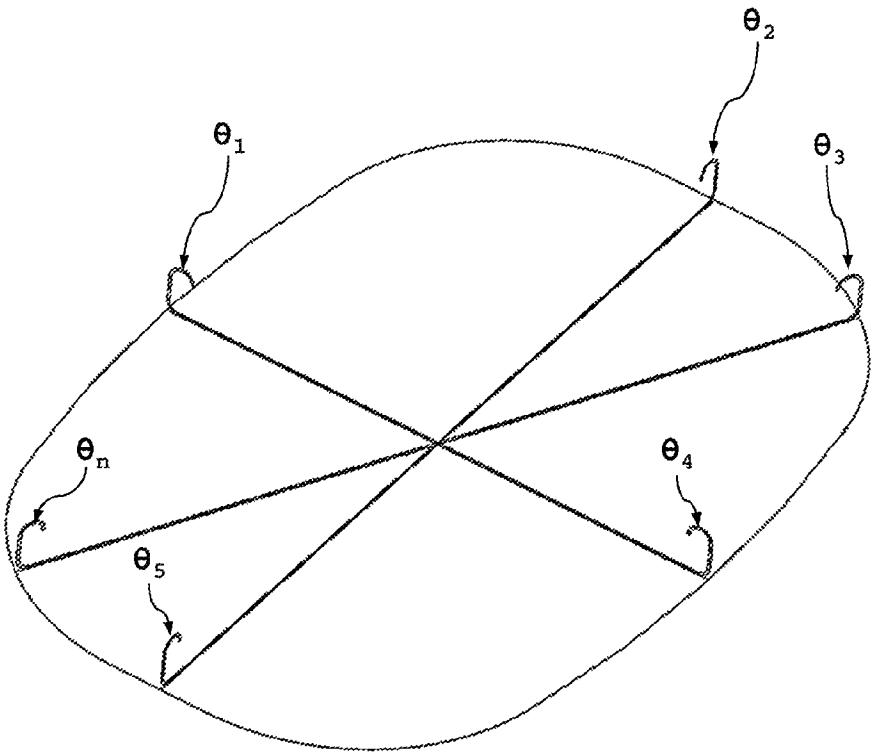
FIG. 13 is a schematic view of a baffle of a muffler according to the present invention showing a baffle lip end with variable curvature angles.

As shown in FIG. 13, in another embodiment of the present invention the curved end portion 43 of the baffle lip 42 has the shape of an arc of a circle subtending an angle θ with the center of the arc of the circle which varies along the circumference of the baffle. This is illustrated in FIG. 13 by various subtended angles $\theta_1$ to $\theta_n$ around the circumference of the baffle plate 41 and the subtended angles may vary in a continuous manner. As the subtended angle has an influence on the stiffness of the baffle 4, the subtended angle θ may be "tuned" along the circumference of the baffle plate 42 according to requirements with regard to stiffness.

Figure 15:
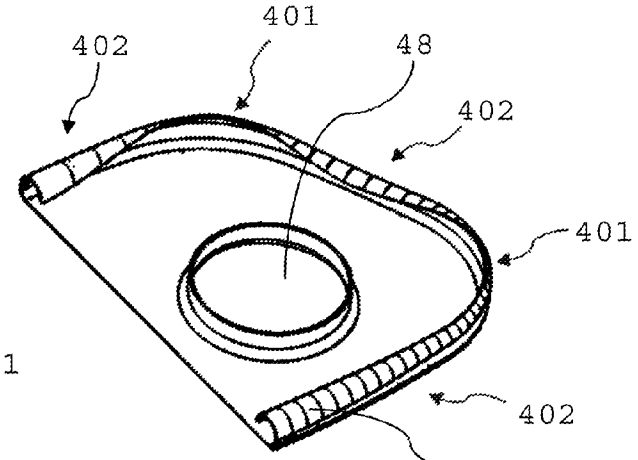
FIG. 15 is a sectional view of the baffle according to FIG. 14.
Figure 14:
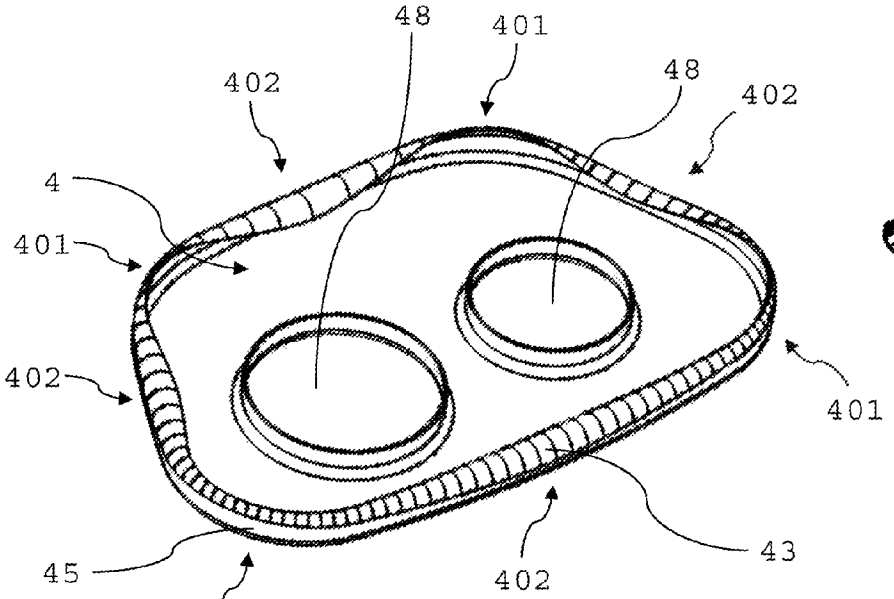
FIG. 14 is a view of a baffle according of a muffler according to another embodiment of the present invention.
Figure 16:
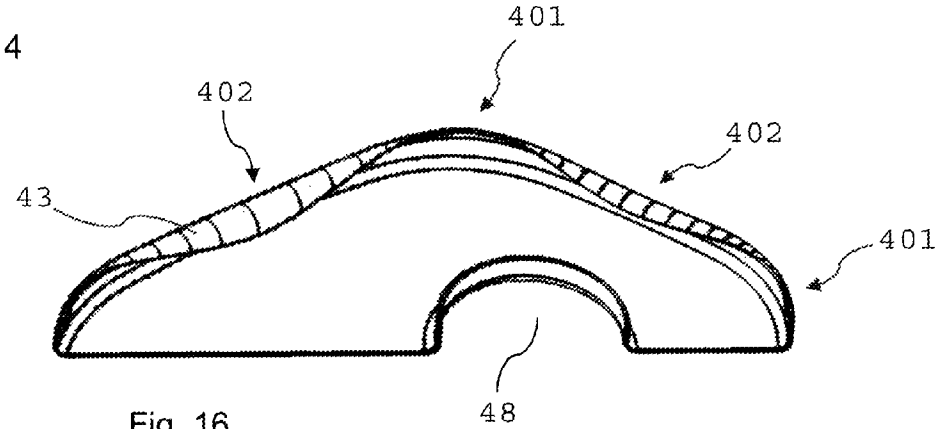
FIG. 16 is another sectional view of the baffle according to FIG. 14.

FIGS. 14 to 16 show another particular embodiment according to the present invention in which the geometries, in particular the curvature angle and the curvature radius of the baffle lip 42 and the length of the contact portion 45 vary. However these geometric parameters may vary independently from one another, while other geometric parameters may be kept constant. It becomes obvious from the figures, that the curvature angle of the inwardly curved end portion 43 in this particular embodiment is smaller at the corners 401 of the baffle 4, where the contact portion bending radius is smaller than at the intermediate portions 402 between the corners 401, when compared to the curvature angle of the inwardly curved end portion 43 at the intermediate portions 402 of the baffle lip between the corners 401 of the baffle 4, where the contact portion bending radius is larger than at the corners 401.

Thus, the curvature angle of the inwardly curved end portion 43 is reduced with decreasing contact portion bending radius.

At the same time, the length of the contact portion 45 of the baffle lip 42 is reduced with increasing curvature angle of the inwardly curved end portion 43. Actually, in the present embodiment, the length of the contact portion 45 is larger at the corners 401 of the baffle 4 than at the intermediate portions 402 of the baffle 4 between the corners 401.

Additionally, from the sectional views of FIGS. 15 and 16, it becomes apparent that the inwardly curved end portion 43 of the baffle lip 42 does not describe an arc of a circle around the complete circumference of the baffle plate in this embodiment.

In this embodiment, the developed length of the baffle lip only varies in a small range of less than 10 mm around the circumference of the baffle plate.

The previously described embodiments do equally apply to half shell mufflers. The housing 1 is then composed of two half shells forming the shell 11 of the housing 1 when assembled rather than using one single shell 11. Usually, the two half shells are turned by 180° with respect to each other and assembled in an overlapped way; the two half shells may have identical or dissimilar form and structure.

While the invention has been described with the aid of embodiments, it is evident for the person skilled in the art that various changes and alterations can be made without departing from the technical teaching underlying the invention. In particular, combinations of individual features of different variants as well as of aspects thereof are also part of the invention disclosed herein. Therefore, the invention is not intended to be limited to the described embodiments, but rather the scope of protection is defined by the appended claims.

The invention claimed is:

1. A muffler for an exhaust system of an internal combustion engine, comprising:

a housing comprising a shell having an inner wall, an inlet pipe and an outlet pipe, the inlet pipe and the outlet pipe extending into an inner space of the housing, for conveying an exhaust gas stream into and out of the inner space of the housing, at least one baffle arranged in the inner space of the housing and made of at least one metal sheet, the baffle comprising a baffle plate having a circumference, a curved connection portion and a baffle lip arranged at the circumference of the baffle plate and being connected to the baffle plate through the curved connection portion, the baffle lip engaging the inner wall of the shell and having an end portion, wherein the end portion of the baffle lip is curved inwardly away from the inner wall of the shell and the inwardly curved end portion of the baffle lip has a tip, the baffle lip having a contact portion which is in contact with the inner wall of the shell, the contact portion being arranged between the curved connection portion and the inwardly curved end portion of the baffle lip, and wherein the inwardly curved end portion has a curvature angle varying along the circumference of the baffle plate, the curvature angle being formed between a tangent to a metal sheet face of the contact portion engaging the inner wall of the shell and a tangent to the inwardly curved end portion of the baffle lip at the tip of the inwardly curved end portion on the same metal sheet face being in contact with the inner wall of the shell at the contact portion.

2. The muffler according to claim 1, wherein the contact portion has a contact portion length (L), and wherein the contact portion length (L) varies along the circumference of the baffle plate.

3. The muffler according to claim 1, wherein the baffle lip has a developed length ranging from the curved connection portion to the tip of the inwardly curved end portion of the baffle lip and the variation of the developed length is less than 10 mm, particularly less than 5 mm, very particularly less than 2 mm, around the circumference of the baffle plate.

4. The muffler according to claim 3, wherein the developed length of the baffle lip is constant around the circumference of the baffle plate.

5. The muffler according to claim 1, wherein the curvature angle of the inwardly curved end portion is reduced with decreasing contact portion bending radius along the circumference of the baffle plate.

6. The muffler according to claim 1, wherein the length of the contact portion of the baffle lip is reduced with increasing curvature angle of the inwardly curved end portion.

7. The muffler according to claim 1, wherein the inwardly curved end portion of the baffle lip can be described by at least one osculating circle having a radius of curvature corresponding to the curvature of the inwardly curved end portion at a location on the inwardly curved end portion and wherein the radius of curvature of the at least one osculating circle varies along the circumference of the baffle plate.

8. The muffler according to claim 1, wherein the curved connection portion can be described by at least one osculating circle having a radius of curvature corresponding to the curvature of the curved connection portion at a location on the curved connection portion wherein the radius of curvature of the at least one osculating circle varies along the circumference of the baffle plate.

9. The muffler according to claim 1, wherein the inwardly curved end portion of the baffle lip has a tip which is arranged at a distance (d) from the inner wall of the shell, the distance (d) being at least 0.5 times the total thickness (t) of the baffle.

10. The muffler according to claim 1, wherein the contact portion of the baffle lip has a length in the range of up to 10 mm, particularly of from 5 mm to 10 mm.

11. The muffler according to claim 1, wherein the baffle plate further comprises stiffening sections.

12. The muffler according to claim 1, wherein the baffle plate has perforations.

13. The muffler according to claim 1, wherein the baffle plate has at least one orifice, the at least one orifice receiving the inlet pipe or the outlet pipe.

14. The muffler according to claim 1, wherein the baffle comprises a first and a second baffle element, each of the first and second baffle elements comprising a baffle plate element having a respective circumference and the baffle plate element of the first baffle element abutting the baffle plate element of the second baffle element, and each baffle plate element having a baffle lip element arranged at the circumference of each respective baffle plate element, each of the baffle lip element engaging the inner wall of the shell and having an end portion element, wherein the end portion element of each baffle lip element is curved inwardly away from the inner wall of the shell and wherein the baffle lip element of the baffle plate element of the first baffle element is arranged in opposite direction to the baffle lip element of the baffle plate element of the second baffle element with respect to the plane formed by the baffle plate elements.

* * * * *